US005104726A

United States Patent [19]

Ross

[11] Patent Number: 5,104,726

[45] Date of Patent: Apr. 14, 1992

[54] WOVEN FABRIC AND PROCESS FOR REINFORCED STRUCTURAL COMPOSITES

[75] Inventor: Edgar A. Ross, Greenville, S.C.

[73] Assignee: Woven Electronics Corporation, Greenville, S.C.

[21] Appl. No.: 459,258

[22] Filed: Dec. 29, 1989

[51] Int. Cl.[5] ..... B32B 7/00

[52] U.S. Cl. ..... 428/246; 139/384 R; 139/408; 428/902; 428/911

[58] Field of Search ..... 428/246, 257, 902, 911; 139/384 R, 408

[56] References Cited

U.S. PATENT DOCUMENTS

| | | | |
|---|---|---|---|
| 2,025,098 | 2/1960 | Frieder et al. | 428/911 |
| 3,256,130 | 6/1966 | Nisbet et al. | 428/911 |
| 3,722,355 | 3/1973 | King | 428/911 |
| 4,292,882 | 10/1981 | Clausen | 428/911 |
| 4,510,198 | 4/1985 | Rheaume | 428/246 |
| 5,021,283 | 6/1991 | Takenaka et al. | 428/902 |

*Primary Examiner*—James J. Bell
*Attorney, Agent, or Firm*—Cort Flint

[57] ABSTRACT

A structure multi-layer fabric (A) is disclosed having a prescribed weave pattern and mesh which provides uniform flexibility and which can be used as structural fabric or impregnated with a resin in a structural composite. The flexibility of the fabric facilitates conforming of the fabric to a desired shape. The rising and sinking warp yarns in the warp and weft directions facilitate effective impregnation by defining trough-like structures in the fabric, as well as enhancing the fabric flexibility. The fabric is characterized as having (N) layers, 2N basic warp yarns woven in a 2N yarn repeat, and 2N−2) basic weft yarns woven in a (2N−2) yarn repeat. In the illustrated embodiment, there are 10 basic weft yarn picks (60,62,64,66,68,70,72,74,76,78) and twelve basic warp yarns (34,36,38,40,42,44,46,48,50,52,54,56) woven in 6 layers (D,E,F,G,H,I). Warp yarns (B) and weft yarns (C) rise and sink in the fabric between outer face (30) and outer face (32). A first plurality of weft spaces (80) are defined in the fabric by rising pairs and sinking pairs of warp yarns (B). A first plurality of warp spaces (86) are defined in the fabric by rising pairs and sinking pairs of weft yarns (C). Two warp yarns (B) are disposed in the first plurality of weft spaces (80), and two weft yarns (C) are disposed in the first plurality of warp spaces (86). A single weft yarn (C) is disposed in the second plurality of warp spaces (88,90).

46 Claims, 8 Drawing Sheets

WOVEN FABRIC AND PROCESS FOR REINFORCED STRUCTURAL COMPOSITES

BACKGROUND OF THE INVENTION

The invention relates to high strength structural composites, and more particularly to a multi-layer fabric for reinforcing composites having increased flexibility in the longitudinal and lateral directions and sufficient thickness for use in forming planar and contoured composite structural parts, ballistics proof clothing, and the like. The fabric is particularly advantageous in making structural composites where curved or angular surfaces may be required by impregnating the flexible fabric which has been conformed to the desired shape and set with a resinous material. For example, curved body parts for automobiles, helicopters, boats, and the like, may be used by impregnating fabric flexed to conform to the shape of the part and set by resin. This provides not only a more light weight part, but one which is extremely strong and/or ballistic resistant.

Reinforced plastics are composites in which a resin is combined with a reinforcing agent to improve one or more properties of the plastic matrix. The resin may be either thermosetting or thermoplastic. Reinforced composites can be designed to provide parts ranging from toys to re-entry insulation shields and miniature printed circuits. The reinforcement is a strong inert material bound into the plastic to improve its strength, stiffness, or impact resistance. The reinforcing agent can be fibrous, powdered, spherical, crystalline, or whisker, and made of organic, inorganic, metallic, or ceramic material. Fibrous reinforcements may be natural, man-made such as synthetic and natural polymers, or carbon, textile glass, metal, ceramic yarns, etc. The fibrous reinforcement may be woven or non-woven. To be effective structurally, there must be a strong bond between the resin and the reinforcement. Conventional molding processes may be used to form the fiber reinforcing materials into a desired shape and impregnate them with a resin. To increase the strength, multiple single layers of fibers, fabrics, and the like, may be built up one at a time until the desired strength is reached. For example, the hand lay-up process for making fiber reinforced composite structures is one of the oldest and simplest methods. Male or female molds can be made from easily worked materials such as wood, plaster, or reinforced plastics. In hand lay-ups, resin and fibers in the form of fabric, woven roving, or mat are simply placed in the mold manually. Successive layers of fibers and resin can be added to build the part to the desired thickness. The problem with composite structures made from multiple layers of single layer woven fabric is that delamination can be a problem where only the adhesive matrix is holding the layers together. The composite layers are particularly vulnerable to shear forces. In the case of multiple non-woven fiber layers, proper orientation of the fibers in the successively formed layers is also a problem to which considerable attention need be given.

It is known to use multi-layer fabric wherein layers are mechanically secured together by woven yarns in numerous constructions. Examples of these fabrics are shown in U.S. Pat. Nos. 453,288 (carpet fabric); 1,335,311 and 4,580,611 (tire fabrics); Canadian No. 643,411, U.S. Pat. Nos. 2,816,578, and 2,899,987 (ballistic fabrics); and 3,749,138 and 4,174,739 (thick tubular fabrics). However, conventional multi-layer fabric has been typically woven with a warp element which undulates between the outer faces of the fabric. The weft yarn, however, is typically woven straight through the fabric. Because the weft is woven straight through the fabric, there are formed multiple layers of generally parallel lamina composed of the straight weft yarns in the lateral direction tending to impair lateral flexibility.

U.S. Pat. No. 2,495,808 and British Patent No. 2,066,308 disclose multi-layer fabrics which are impregnated with a gum and resin, respectively. The fabrics are woven with an undulating yarn between the outer faces woven in the longitudinal direction only.

French Patent No. 427,677 discloses a felt or velvet-like fabric which can have any desired thickness. To produce the felt-like velvet fabric, the warps are arranged in layers having progressively fewer yarns. Both the weft and warp yarns are indicated to follow the same slanted course, some of which go through the entire thickness of the fabric while the others only go through a portion of that thickness.

While prior art multi-layer fabrics have been woven in many multi-layered forms for different applications, the transfer of multi-layer fabric technology has not been readily made to the field of reinforced composite structures. In particular, the prior multi-layer fabrics have not been entirely suitable or satisfactory for the manufacture of contoured structures, particularly for reinforced composite structures or ballistic clothing where uniform flexibility is desired in all directions.

Accordingly, an object of the present invention is to provide a woven multi-layer fabric and process for manufacturing composite structures having uniform flexibility.

Another object of the invention is to provide polymeric structural composites having increased strength using multi-layer fabrics with uniform flexibility and thickness.

Another object of the invention is to provide a multi-layer fabric having uniform lateral and longitudinal flexibility so that the fabric may be made to conform to a variety of contours and shapes for the manufacture of reinforced structural composites.

Another object of the invention is to provide a multi-layer fabric having a weave which provides uniform directional flexibility and a mesh which may be effectively impregnated with a conformal material for setting the fabric in the form of a desired structural part.

Another object of the invention is to provide a multi-layer fabric having weave which provides increased flexibility, and a mesh and thickness which effectively protects against the intrusion of ballistic particles.

Another object of the invention is to provide a process for making and manufacturing contoured composite articles and parts by using multi-layered fabrics having uniform flexibility and sufficient thickness to be conformed to a shape of a desired structure and a mesh which can effectively be impregnated with a resin for setting in that shape.

Another object of the present invention is to provide a process for making and manufacturing contoured articles and parts by using multi-layered fabrics having uniform directional flexibility which are conformed to the shape of the article or part and then impregnated with the resin whereby the resulting article or part is light weight, yet has high structural integrity and/or is effective against ballistic projectiles.

SUMMARY OF THE INVENTION

The above objectives are accomplished according to the invention by providing a high-strength structural composite of the type which includes a fabric impregnated with a polymeric setting material wherein the fabric comprises a multi-layer fabric having uniform directional flexibility. A plurality of warp yarns are woven in a first direction in undulations which run between the first and second outer faces of the fabric. A plurality of weft yarns are woven in a second direction in undulations which run between the first and second outer faces of the fabric. The plurality of warp yarns and second plurality of weft yarns are interwoven together in a prescribed pattern and mesh which provides uniform flexibility in both the first and second directions. A polymeric setting material occupying the mesh of the fabric to set the fabric in a shape of a desired structure with the runs of the warp and weft yarns extending between the outer faces facilitating effective impregnation of the fabric with the setting material. Preferably, the warp yarns rise and sink in a warp yarn repeat pattern between the first and second outer surfaces, and the weft yarns rise and sink in a weft yarn repeat pattern between the first and second outer surfaces. A pair of rising and sinking weft yarns is inserted in a space between pairs of rising and pairs of sinking warp yarns, and a pair of rising and sinking warp yarns are inserted in a space between pairs of rising and sinking weft yarns. The multi-layer structural fabric has uniform directional flexibility and comprises N layers, where N is the number of layers and 2N basic warp yarns woven in a 2N yarn repeat. There are $(2N-2)$ basic weft yarns woven in a $(2N-2)$ yarn repeat. There are $2N \times 2N$ total warp and weft yarns in a complete pattern. A process of constructing a reinforced composite structure having increased structural integrity includes utilizing the multi-layer woven fabric having multiple woven layers. The multiple layers include warp yarns which rise and sink between the outer faces and are interwoven with weft yarns which rise and sink between the first and second outer faces so that uniform flexibility is provided. The multi-layer flexible fabric is conformed to the desired shape of a structure, and impregnated with a shape-setting material which sets the fabric in the desired structural shape.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
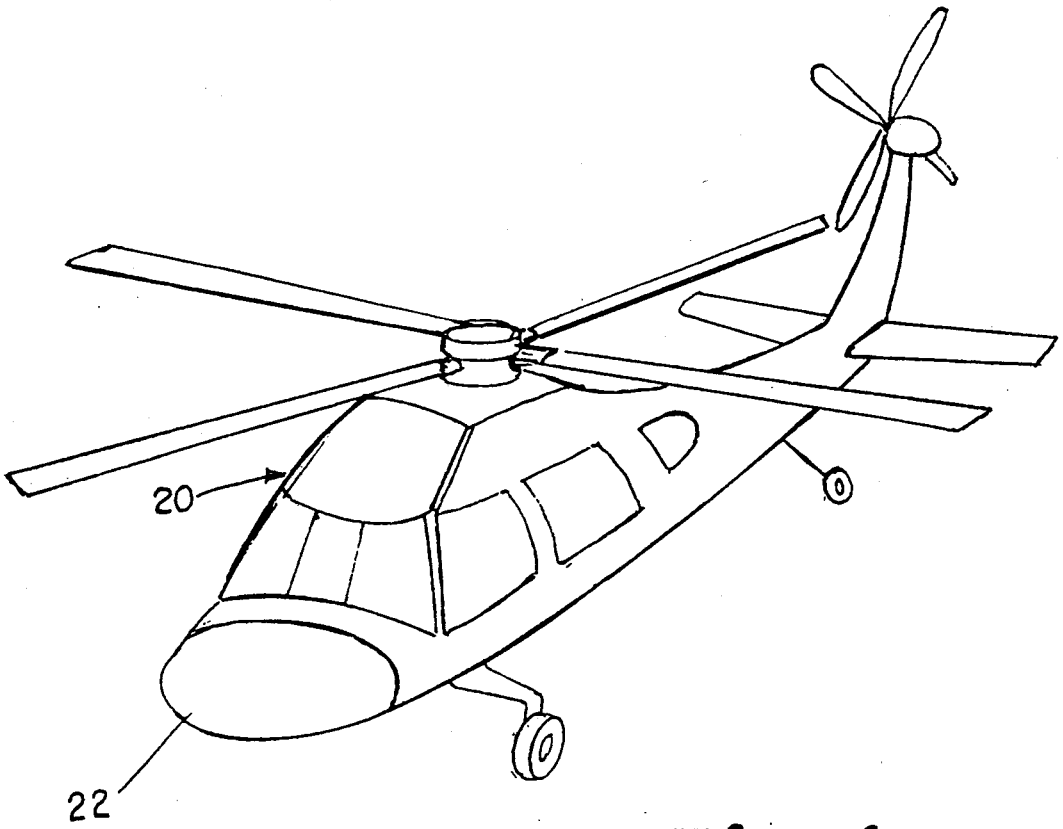
FIG. 1 is a perspective view of a helicopter having a nose constructed from a structural composite reinforced with a multi-layer flexible fabric in accordance with the present invention.
Figure 3:
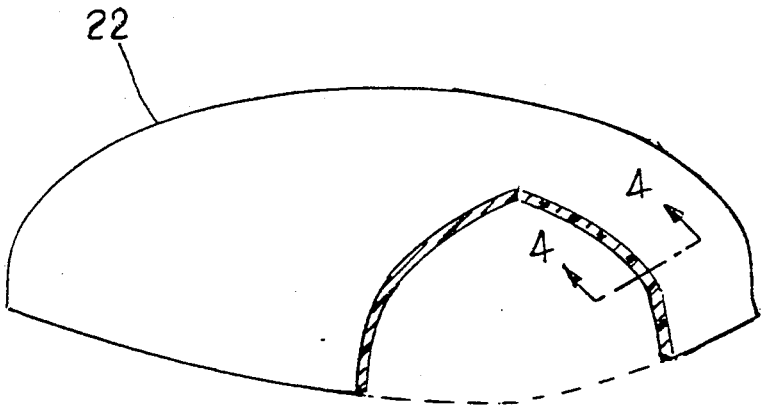
FIG. 3 is a perspective view of a helicopter nose constructed as a reinforced structural composite according to the invention with part cut away.
Figure 4:
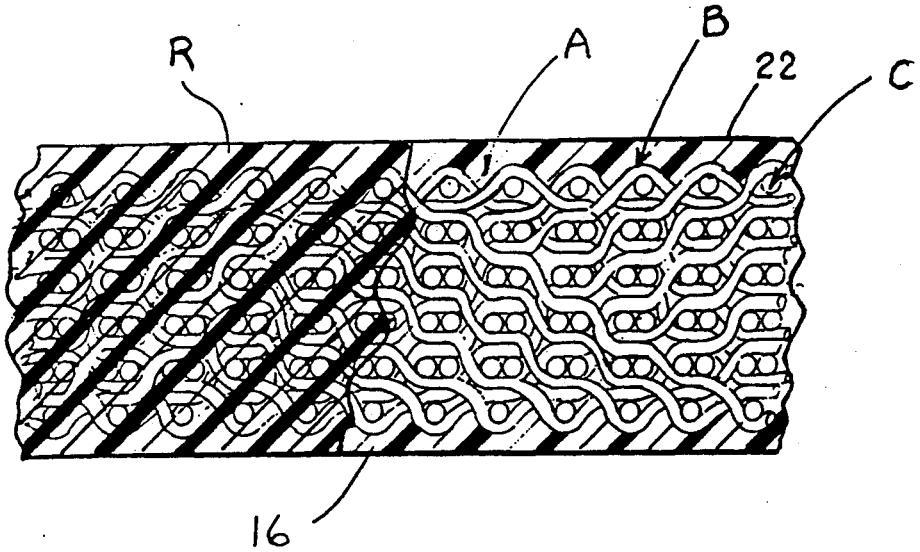
FIG. 4 is a sectional view taken along line 4—4 of FIG. 3.

Referring now in more detail to the drawings, the invention will now be explained in relation to a structural composite part for a helicopter, as an example. As can best be seen in FIG. 1, a helicopter 20 is illustrated having a forward contoured nose 22. Nose 22, as well as the entire underneath portion of the helicopter are important structural members since they house important electronic and mechanical elements and are highly susceptible to damage from ballistics and the like. As an example of a structural composite made in accordance with the invention, nose 22 will now be described. As can best be seen in FIG. 3, nose 22 has a contour shape which is curved in three degrees of freedom. Contoured nose 22 may be made in accordance with known conventional molding techniques. For example, as can best be seen in FIG. 2, a male dye 24 having a contour preformed to that of the desired shape of nose 22 may be utilized. A structural fabric, designated generally as A, which will be described later in more detail, is laid upon dye 24 and is made to conform to the shape of dye 24 by a vacuum applied at a port 26 which draws fabric A down upon dye 24 by small openings formed in the dye to which the vacuum is communicated. In the next step, a conformal material which sets fabric A in the desired shape may be applied to the fabric by any suitable means. As illustrated, the conformal material may be a liquid resin "R" which is sprayed on the fabric. The resin thoroughly impregnates the fabric as the liquid resin is drawn through the fabric by the suction. Fabric A is woven in accordance with the invention to have a flexibility and mesh which facilitates conforming of the fabric to dye 24 and impregnation with resin "R" or other suitable setting material. As can best be seen in FIG. 4, a sectional view is illustrated of the final structural composite wherein fabric A is impregnated with resin "R" to set the shape of the fabric in accordance with nose 22 of helicopter 20. While a vacuum has been utilized to conform and impregnate the fabric, other suitable means may also be utilized in accordance with known molding techniques, for example, a female dye may be utilized and the resin may be forced through the mesh of woven fabric A by other suitable impregnator devices known in the art.

Figure 5:
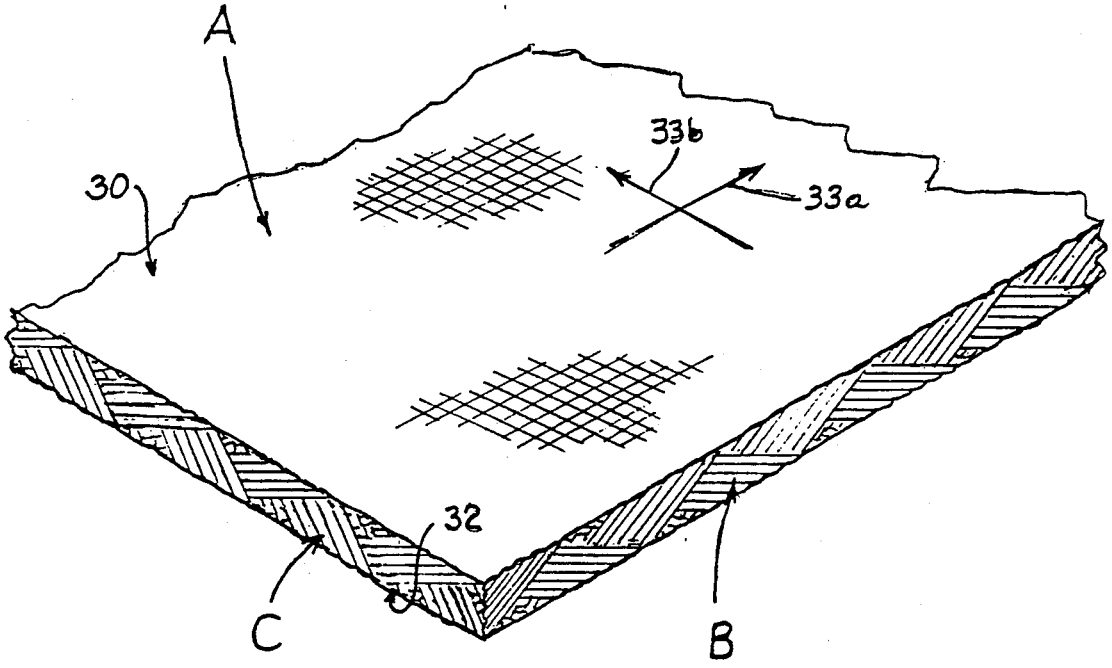
FIG. 5 is a perspective view of a woven multi-layer fabric for forming a structural part according to the invention.

Referring now in more detail to the drawings, a multi-layer unidirectionally flexible fabric, designated generally as A, is illustrated having a first outer face, designated generally as 30, and a second outer face designated generally as 32. A plurality of warp yarns B extend in a first direction **33*a* in the fabric, and a plurality of weft yarns C extend in a second direction 33*b* in the fabric transverse to the first direction. As can best be seen in FIGS. 5 and 6, plurality of warp yarns B are woven in undulations between outer faces 30 and 32**. As can best be seen in FIGS. 5 and 7, plurality of yarns C are also woven between outer faces 30 and 32 in undulations. The term "yarns" means any product of substantial length and relatively small cross-section consisting of fibers and/or filaments with or without twists. The weft is referred to as a yarn or a pick, the meaning being the same. The fibers may be any textile fibers either natural, or man-made such as synthetic polymers, natural polymers, or carbon, textile glass, metal, or ceramic yarns, etc.

The weave will now be described in more detail by reference to FIGS. 6 and 7–18. In the preferred weave for a multi-layer, unidirectional flexible fabric A, the fabric may include any number of layers "N". The weave may be characterized by the following:

N=the number of layers

2N=the number of basic warp yarns in the warp yarn repeat, and the number of warp yarn repeats in the pattern 2N−2 =the number of basic weft yarns in the weft yarn repeat, and the number of yarn repeats in the pattern 2N×(2N−2)=the number of yarns in the warp or weft repeat 2N×2N=the total number of yarns in a complete pattern.

Figure 6:
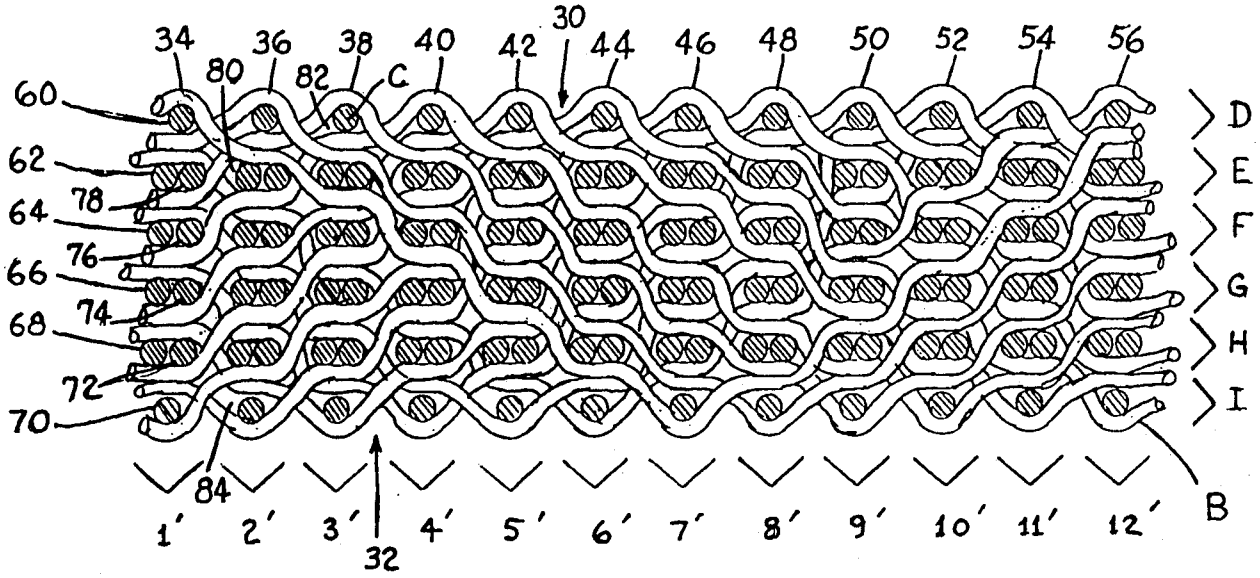
FIG. 6 is a sectional view illustrating a warp yarn pattern for a multi-layer structural flexible fabric constructed according to the invention.
Figure 7:
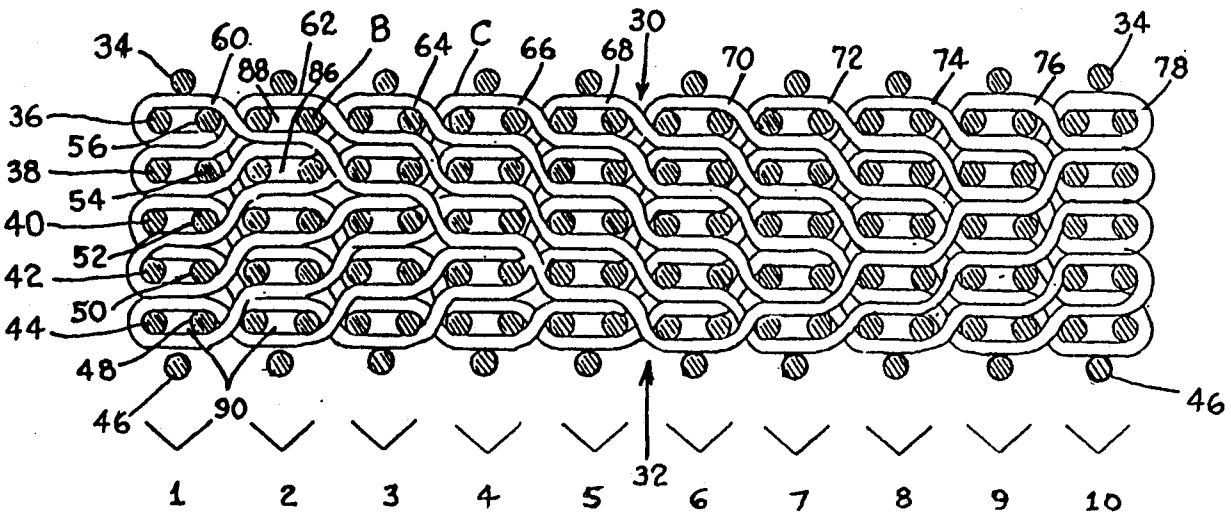
FIG. 7 is a sectional view illustrating a weft yarn pattern for a multi-layer structural flexible fabric constructed according to the invention.

As an example, a 6-layer fabric will have 6 layers, D-I, with 12 basic repeating warp yarns woven in a 12-yarn repeat (FIG. 6). The 6-layer fabric will have 10 basic weft yarns woven in a 10-yarn repeat (FIG. 7), and the fabric will have 120 picks in a complete pattern. As can best be seen in FIG. 6, first plurality of yarns B includes 12 basic warp yarns identified as 34, 36, 38, 40, 42, 44, 46, 48, 50, 52, 54, and 66. There are 12 yarn repeat positions 1'–12'. As can best be seen in FIG. 7, fabric A includes 10 basic weft yarn picks. There is a first weft yarn 60, second weft yarn 62, third weft yarn 64, fourth weft yarn 66, fifth weft yarn 68, sixth weft yarn 70, seventh weft yarn 72, eighth weft yarn 74, ninth weft yarn 76, and tenth weft yarn 78. There are 10 yarn repeat positions, 1–10. Each successive pick is displaced by a pair of warp yarns on each pass through the fabric.

Figure 2:
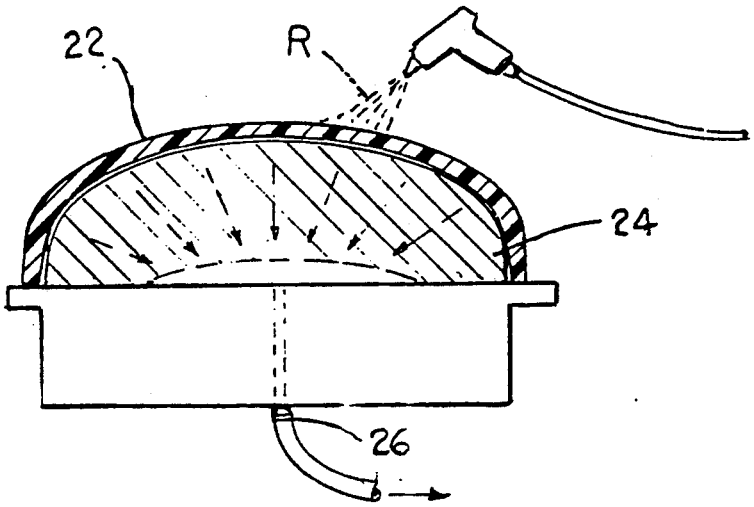
FIG. 2 is a section view of a process form forming structural composites according to the invention.

Preferably, warp yarns 34–56 are woven in the following manner between faces 30 and 32 of fabric A, as can best be seen in FIG. 2. As each warp yarn passes from face 30 to face 32, it weaves in repeat wherein warp yarns B weave over (2N−2) picks in a first position; and then the warp yarns weave over (2N−X) picks for the next (N−1) positions, where X=the next (N−1) consecutive by increasing odd integers beginning with 1, as the warp yarns run between the first and second outer faces. Successive warp yarns are displaced one pick in the warp direction in the warp yarn repeat. For example, in the 12 warp repeat of FIG. 7, were N=6, warp yarn 34 weaves over 10 picks, over 9 picks, over 7 picks, over 5 picks, over 3 picks, and over 1 pick between faces 30 and 32. Between faces 30 and 32, warp 34 weaves under 10 or over zero picks, over 1 pick, over 3 picks, over 5 picks, over 7 picks, and over 9 picks. Afterwards, the warp repeat begins.

Likewise, weft yarns 60–78 are preferably woven in the following manner, as can best be seen in FIG. 6 and subsequent sections. The weft yarns weave in a repeat wherein said weft yarns weave under one warp yarn in a first position, and then under (2N−X) warp yarns for the next (N−1) positions, where X is the (N−1) decreasing consecutive odd integers beginning with (2N−3). Each successive weft yarn is woven in a pick which is displaced in the weft direction by one warp yarn position. For example, in the 10 weft repeat of FIG. 6, weft yarn 62 begins its weave through the fabric under warp yarn 36 at a position displaced 1 warp yarn repeat from the left-hand side of the fabric, as viewed in FIG. 6. Weft 62 then weaves under 3 warp yarns, under 5 warp yarns, under 7 warp yarns, under 9 warp yarns, and under 11 warp yarns to face 32. the weft yarn then repeats the weave rising to face 30. The same is true for the remaining picks 64–78. This provides many advantages for the fabric constructed according to the present invention. By weaving weft yarns C between outer faces 30 and 32 in the fabric, as well as weaving warp yarns B in rising and sinking undulations between the outer faces, uniform flexibility in both the warp and weft directions, i.e. longitudinal and lateral directions, is achieved.

Woven multi-layer structural fabric A includes a plurality of yarn layers woven between the first and second outer faces 30 and 32 which include warp yarns C and weft yarns woven generally transverse to one another. Warp yarns B rise and sink in a warp yarn repeat pattern between the first and second outer faces, and weft yarns C rise and sink in a weft yarn repeat pattern between the first and second outer faces. A pair of adjacent rising and sinking weft yarns are inserted in a plurality of weft spaces 80 between pairs of rising and sinking warp yarns. A pair of adjacent rising and sinking warp yarns B are inserted in a plurality of warp spaces 86 between pairs of rising and sinking weft yarns C. For example, as can best be seen in FIG. 6, there is a space 80 between a pair of rising warp yarns 38, 40 and a pair of sinking warp yarns 34, 56 in which two weft yarn picks 62 and 78 are disposed. In layer D, at first face 30, there is a space 82 defined between a sinking warp yarn 34, a rising warp yarn 38, and a rising and sinking warp yarn 38 in which a single weft yarn 60 is inserted. In layer I of face 32, there is a space 84 defined by a rising warp yarn 46, a sinking warp yarn 50, and a rising and sinking warp yarn 48 in which a single weft yarn 70 is inserted. As can best be seen in FIG. 7, there is a space 86 defined between a pair of rising weft yarns 64, 66 and a pair of sinking weft yarns 60, 78 occupied by two warp yarns 38 and 54. In layer D at face 30 there is a space 84 defined by a sinking weft yarn 60, a rising weft yarn 64, and a rising and sinking weft yarn 62 in which two warp yarns 36 and 56 are disposed. In layer I at face 32 there is a space 90 defined by a rising weft yarn 70, a sinking weft yarn 74, and a sinking and rising weft yarn 72 in which a pair of warp yarns 46, 48 are disposed.

The undulation pattern of warp yarns B and weft yarns C creates interstices in the mesh of the woven fabric which is advantageous both to flexibility and also impregnation of the fabric when used to form structural parts as will be described hereinafter. The warp and weft undulations form troughs in the fabric between outer faces 30, 32 which facilitate good saturation of the resin or other conformal material in the fabric for effective impregnation and setting of the fabric in a desired shape. This weave also provides good flexibility and good resistance to penetration of ballistics when used as a ballistics fabric.

Figure 8:
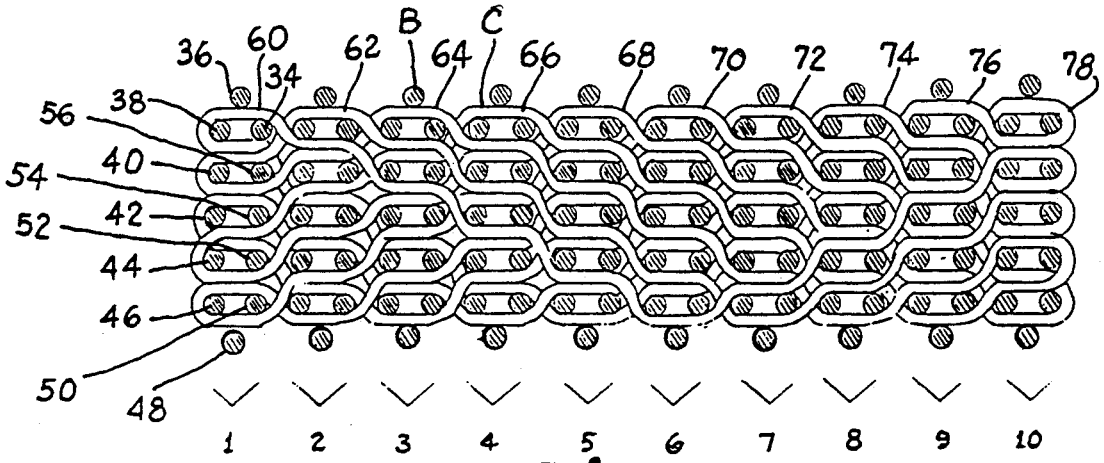
FIGS. 8–18 are the remaining weft sections for a complete pattern for a multi-layer structural fabric constructed according to the invention having 6 layers.
Figure 9:
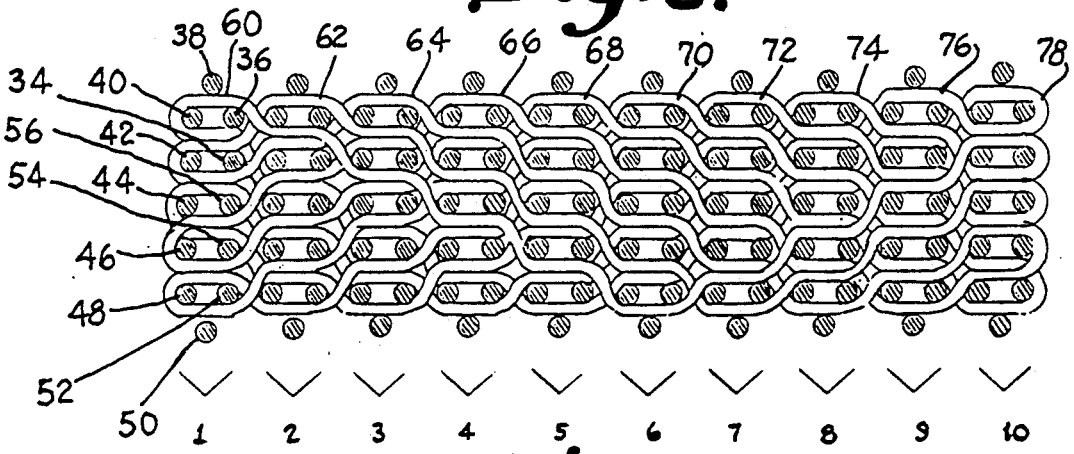
Figure 10:
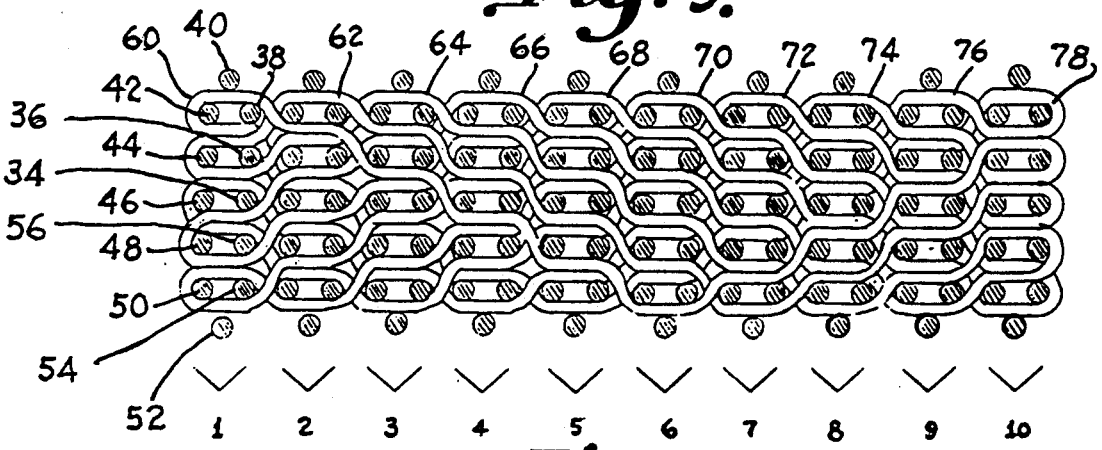
Figure 11:
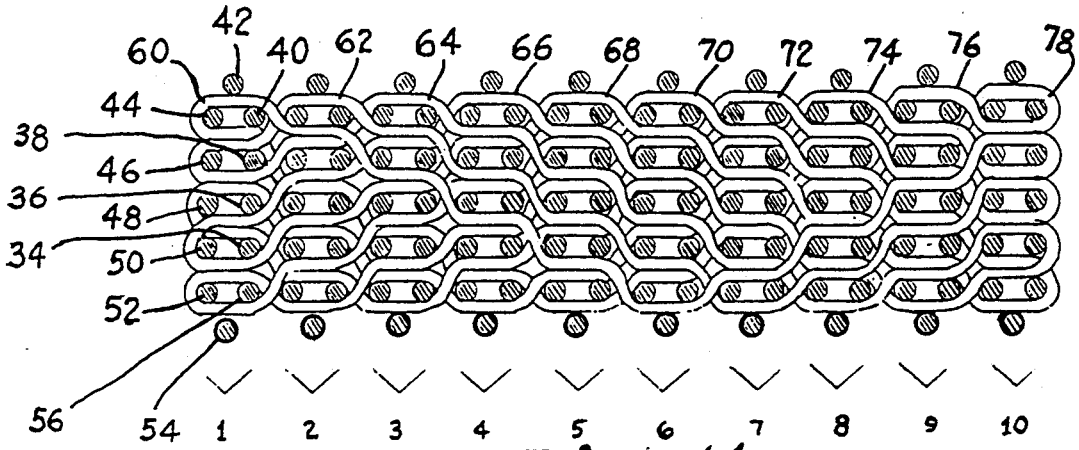
Figure 12:
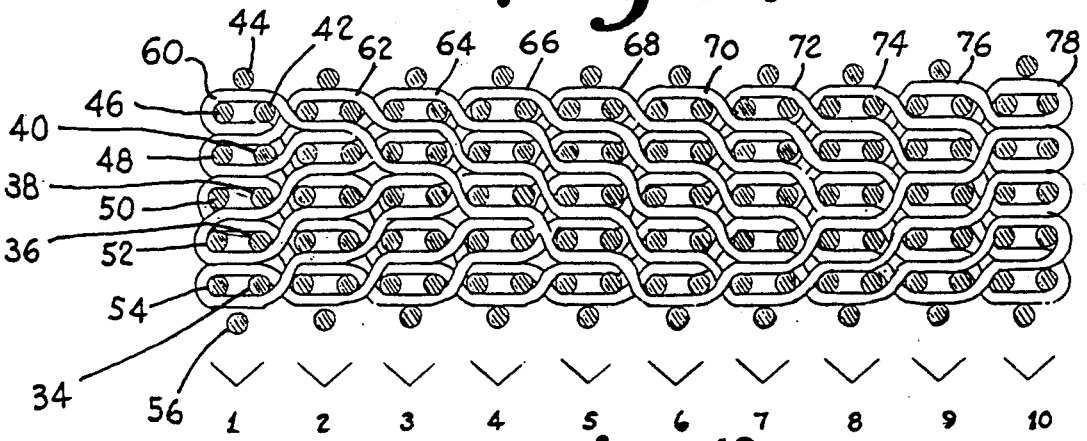
Figure 13:
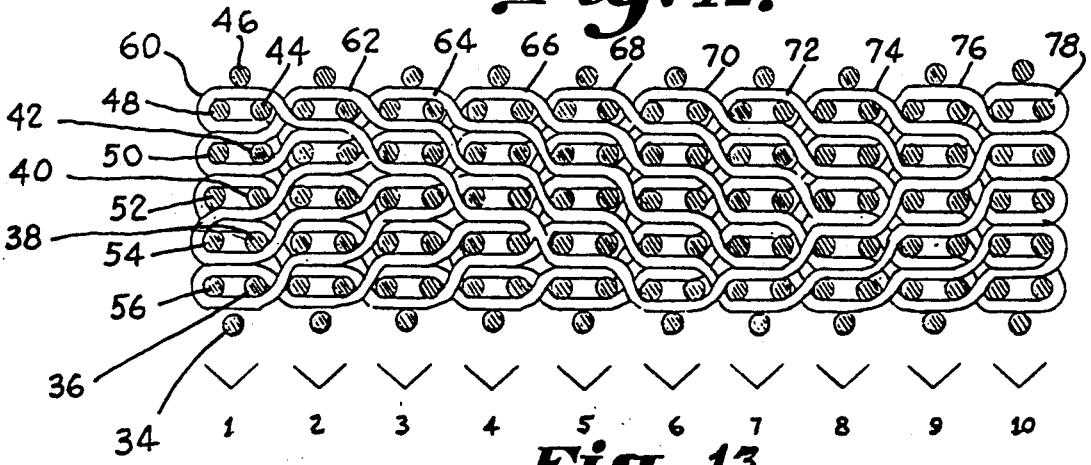
Figure 14:
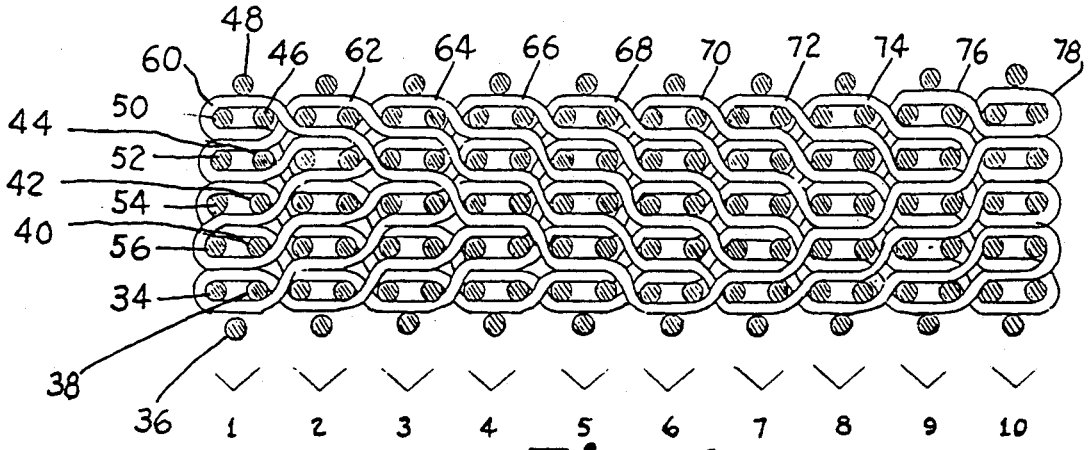
Figure 15:
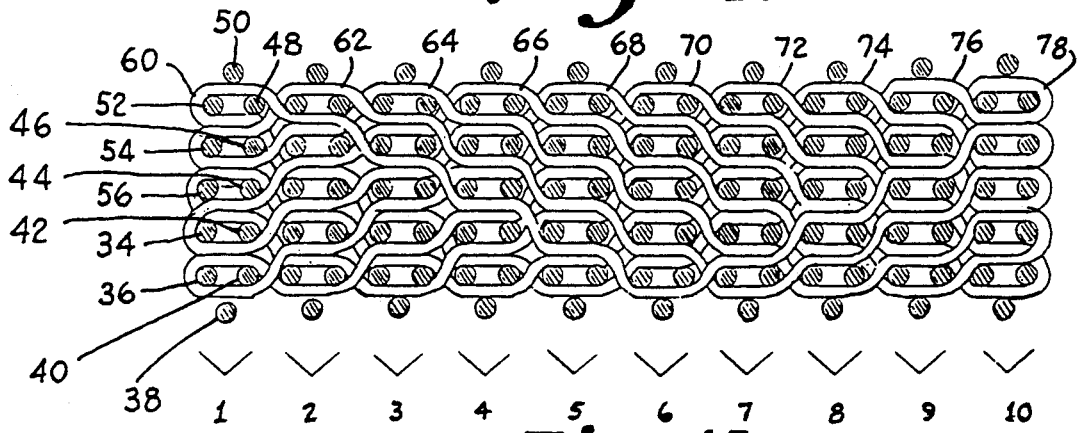
Figure 16:
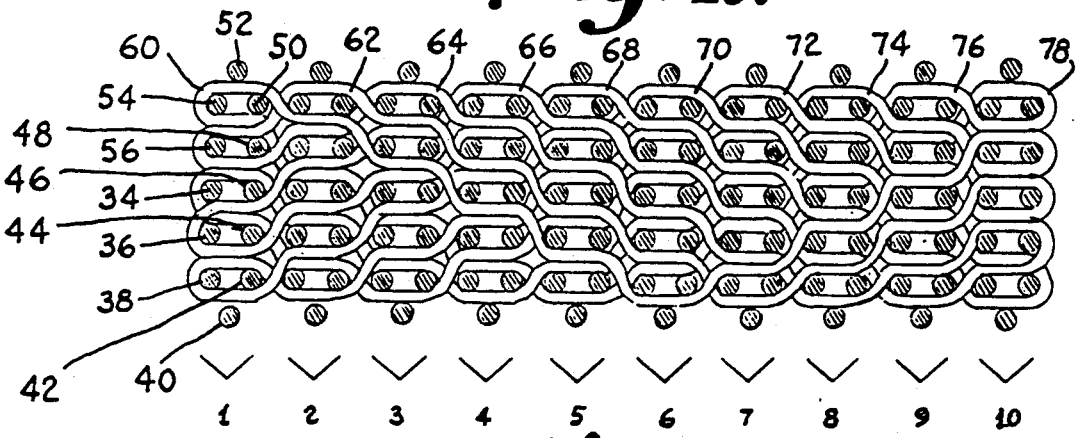
Figure 17:
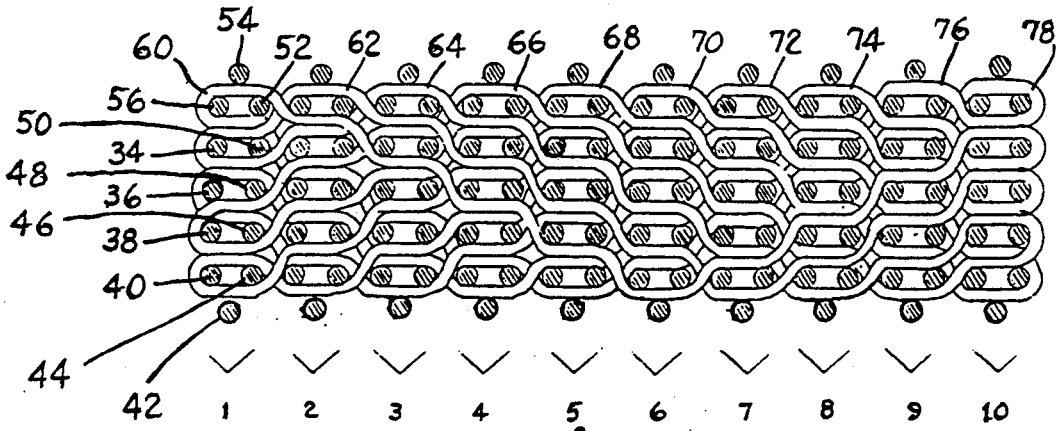
Figure 18:
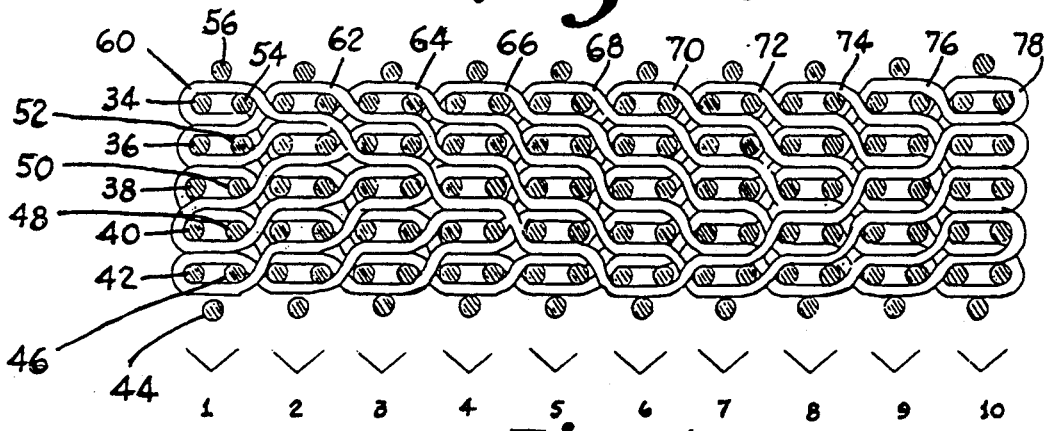

The remaining yarn section patterns of the fabric to form a complete pattern and are illustrated in FIGS. 8–18, it being understood, of course, that the unnumbered warp yarns, or circles, in positions 2–10 of each figure are the same as the numbered warp yarns, or circles, in position 1 as far as yarn identification. FIGS. 7–18 illustrate the 12 yarn sections of the yarn repeat pattern for the 12 basic warp yarns 34–56. By referring to the figures, the rotational pattern of the warp yarns in layers D-I can be seen. The general rotational pattern is that successive warp yarns move one layer for each pick of the weft yarn. For example, beginning with FIG. 7, it can be seen that warp 34 is on top which is repeated for each of the 10 positions. In the next yarn repeat section, warp 34 has moved down one layer, and warp 36 has moved up (FIG. 8). All the warps rotate in the clockwise direction by one layer in position 1 and the remaining positions are the same weave. The same rotational pattern occurs in the remaining 10 yarn sections of FIGS. 9–18. While the invention has been described in relation to a multi-layer fabric having 6 layers, it being understood, of course, that the invention may be applied to multi-layer fabric having any number (N) of layers depending on the application being made.

The density of warp and weft yarns in the fabric may vary depending on the application being made. For example, in a structural fabric for ballistic proof clothing, a very fine denier yarn may be used to provide a very tight weave. As an example, a 600 denier yarn may be woven in the warp and weft systems with a yarn density of 288 warp yarns per inch and 200 picks per inch. In a structural composite, a coarser yarn may be used, for example, a 2953 denier yarn may be used with a yarn density 144 warp ends and 120 weft yarns per inch. A typical fabric may be woven in a 60 inch width using a jacquard loom.

A process of the invention for weaving a structural multi-layer fabric having generally uniform flexibility and sufficient thickness to form three-dimensional structures and the like comprises weaving a plurality of warp yarns B in a warp direction 33*a*, and weaving a plurality of picks C of a weft yarn in a weft direction 33*b* in the fabric transverse to the warp direction. The process includes weaving the warp yarns in undulations rising and sinking in runs between the first and outer faces, and weaving the weft yarn picks in the weft direction in undulations rising and sinking in runs between the first and second outer faces. The process further includes weaving adjacent ones of the warp yarns in rising and sinking pairs between the first and second outer faces. Adjacent ones of the weft yarns are woven in rising and sinking pairs between the first and second outer faces. Rising and sinking pairs of weft yarns are inserted between pairs of rising and pairs of sinking warp yarns.

A process of constructing a reinforced composite structure having increased structural integrity comprises utilizing the multi-layer woven fabric having rising and sinking warp yarns interwoven with rising and sinking weft yarns so that uniform flexibility is provided; conforming the multi-layer flexible fabric to the shape of the structure; and impregnating the fabric with a shape-setting material which sets the fabric in the desired structural shape. The process includes impregnating said fabric preferably with a resin, and impregnating the fabric by drawing the resin through the fabric with a vacuum, or other known molding techniques.

While a preferred embodiment of the invention has been described using specific terms, such description is for illustrative purposes only, and it is to be understood that changes and variations may be made without departing from the spirit or scope of the following claims.

What is claimed is:

1. A high-strength structural composite of the type which includes a fabric impregnated with a polymeric setting material wherein said fabric comprises:

a multi-layer fabric having uniform directional flexibility, said fabric having a first outer face, and a second outer face spaced from said first outer face, and a plurality of fabric layers between said first and second outer faces;

a plurality of warp yarns extending in a first direction in said fabric;

a plurality of weft yarns extending in a second direction in said fabric transverse to said first direction;

said plurality of warp yarns being woven in said first direction in undulations which run between said first and second outer faces;

said plurality of weft yarns being woven in said second direction in undulations which run between said first and second outer faces of said fabric;

said plurality of warp yarns and said second plurality of weft yarns being interwoven together in a prescribed pattern and mesh which provides uniform flexibility in both said first and second directions; and said polymeric setting material occupying said mesh of said fabric to set said fabric in a shape of a desired structure with said runs of said warp and weft yarns extending between said outer faces facilitating effective impregnation of said fabric with said setting material.

2. The fabric of claim 1 wherein said warp and weft yarns rise and sink in said fabric, a first plurality of weft spaces being defined in said fabric by rising pairs and sinking pairs of said warp yarns, a first plurality of warp spaces being defined in said fabric by rising pairs and sinking pairs of said weft yarns, two of said warp yarns being disposed in said first plurality of weft spaces, and two of said weft yarns being disposed in said first plurality of warp spaces.

3. The fabric of claim 2 including a second plurality of warp spaces being defined in layers of said fabric at said outer faces which are defined by a rising warp yarn, a sinking warp yarn, and a rising and sinking warp yarn, and a single weft yarn being disposed in said second plurality of warp spaces.

4. The fabric of claim 1 wherein said warp yarns weave in repeat wherein said warp yarns weave over $(2N-2)$ picks in a first position; and then said warp yarns weave over $(2N-X)$ picks for the next $(N-1)$ positions, where $X=$the next (N-consecutive odd integers beginning with 1, as said warp yarns run between said first and second outer faces.

5. The fabric of claim 4 wherein successive warp yarns are displaced one pick in said first direction in said warp yarn repeat.

6. The fabric of claim 4 wherein said weft yarns weave in a repeat wherein said weft yarns weave under one warp yarn in a first position, and then under $(2N-X)$ warp yarns for the next $(N-1)$ positions, where X is the $(N-1)$ consecutively decreasing odd integers beginning with $(2N-3)$.

7. The fabric of claim 6 wherein each successive weft yarn is woven in a pick which is displaced in said second direction by one warp yarn position.

8. The fabric of claim 1 wherein said weft yarns weave in a repeat wherein said weft yarns weave under one warp yarn in a first position, and then under $(2N-X)$ warp yarns for the next $(N-1)$ positions, where X is the (N−1) consecutively decreasing odd integers beginning with (2N−3).

9. The fabric of claim 8 wherein each successive weft yarn is woven in a pick which is displaced in the weft direction by one warp yarn position.

10. The fabric of claim 1 wherein said warp yarns rotate in said fabric among said layers in a rotational pattern wherein said warp yarns move one layer for each weft repeat pattern.

11. A multi-layer structural fabric having uniform directional flexibility, a first outer face, and a second outer face spaced from said first outer face, and a plurality of fabric layers between said first and second outer faces wherein said fabric comprises:

N layers, where N is the number of layers;

2N basic warp yarns woven in a 2N yarn repeat;

(2N−2) basic weft yarns woven in a (2N−2) yarn repeat; and

2N×2N total warp and weft yarns in a complete pattern.

12. The fabric of claim 11 wherein said warp yarns run from said first outer face to said second outer face in said warp yarn repeats, and said weft yarns are interlaced with said warp yarns and run from said first outer face to said second outer face in said weft yarn repeats.

13. The fabric of claim 11 wherein said warp and weft yarns rise and sink in said fabric, a first plurality of weft spaces being defined in said fabric by rising pairs and sinking pairs of said warp yarns, a first plurality of warp spaces being defined in said fabric by rising pairs and sinking pairs of said weft yarns, two of said warp yarns being disposed in said first plurality of weft spaces, and two of said weft yarns being disposed in said first plurality of warp spaces.

14. The fabric of claim 13 including a second plurality of warp spaces being defined in layers of said fabric at said outer faces which are defined by a rising warp yarn, a sinking warp yarn, and a rising and sinking warp yarn, and a single weft yarn being disposed in said second plurality of warp spaces.

15. The fabric of claim 11 wherein said warp yarns rotate in said fabric among said layers in a rotational pattern wherein said warp yarns move one layer for each weft repeat pattern.

16. The fabric of claim 11 wherein said warp yarns weave in repeat wherein said warp yarns weave over (2N−2) picks in a first position; and then said warp yarns weave over (2N−X) picks for the next (N−1) positions, where X=the (N−1) consecutive by increasing odd integers beginning with 1, as said warp yarns run between said first and second outer faces.

17. The fabric of claim 14 wherein successive warp yarns are displaced one pick in the warp direction in said warp yarn repeat.

18. The fabric of claim 14 wherein said weft yarns weave in a repeat wherein said weft yarns weave under one warp yarn in a first position, and then under (2N−X) warp yarns for the next (N−1) positions, where X is the (N−1) decreasing consecutive odd integers beginning with (2N−3).

19. The fabric of claim 18 wherein each successive weft yarn is woven in a pick which is displaced in the weft direction by one warp yarn position.

20. The fabric of claim 11 wherein said weft yarns weave in a repeat wherein said weft yarns weave under one warp yarn in a first position, and then under (2N−X) warp yarns for the next (N−1) positions, where X is the (N−1) decreasing consecutive odd integers beginning with (2N−3).

21. The fabric of claim 20 wherein said successive weft yarn is woven in a pick which is displaced in the weft direction by one warp yarn position.

22. A woven multi-layer structural fabric comprising:

a first outer face and a second outer face spaced from said first outer face;

a plurality of yarn layers arranged between said first and second outer faces;

said layers including warp yarns and weft yarns woven generally transverse to one another;

said warp yarns rising and sinking in a warp yarn repeat pattern between said first and second outer faces;

said weft yarns rising and sinking in a weft yarn repeat pattern between said first and second outer faces;

at least two picks of said weft yarn being inserted in a space between pairs of rising and pairs of sinking warp yarns; and at least two of said warp yarns disposed in a space between pairs of rising and pairs of sinking weft yarns.

23. The fabric of claim 22 including an outer layer at said first face which includes single weft yarn picks inserted in spaces defined between a sinking warp yarn, a rising warp yarn, and a rising and sinking warp yarn.

24. The fabric of claim 23 including an outer layer at said second face which includes spaces defined by a rising warp yarn, a sinking warp yarn, and a rising and sinking warp yarn in which a single weft yarn is inserted.

25. The fabric of claim 24 including an outer layer at said first face which includes spaces defined by a sinking weft yarn, a rising weft yarn, and a rising and sinking weft yarn in which two warp yarns are disposed.

26. The fabric of claim 25 including an outer layer at said second layer in which spaces are defined by a rising weft yarn, a sinking weft yarn, and a sinking and rising weft yarn in which a pair of warp yarns are disposed.

27. The fabric of claim 22 wherein said warp yarns weave in repeat wherein said warp yarns weave over (2N−2) picks in a first position; and then said warp yarns weave over (2N−X) picks for the next (N−1) positions, where X=the next (N−1) consecutive odd integers beginning with 1, as said warp yarns run between said first and second outer faces.

28. The fabric of claim 27 wherein successive warp yarns are displaced one pick in the warp direction in said warp yarn repeat.

29. The fabric of claim 28 wherein said weft yarns weave in a repeat wherein said weft yarns weave under one warp yarn in a first position, and then under (2N−X) warp yarns for the next (N−1) positions, where X is the (N−1) decreasing consecutive odd integers beginning with (2N−3).

30. The fabric of claim 29 wherein each successive weft yarn is woven in a pick which is displaced in the weft direction by one warp yarn position.

31. The fabric of claim 30 wherein said weft yarns weave in a repeat wherein said weft yarns weave under one warp yarn in a first position, and then under (2N−X) warp yarns for the next (N−1) positions, where X is the (N−1) decreasing consecutive odd integers beginning with (2N−3).

32. The fabric of claim 31 wherein each successive weft yarn is woven in a pick which is displaced in the weft direction by one warp yarn position.

33. A process for weaving a structural multi-layer fabric having generally uniform flexibility in the warp and weft directions and sufficient thickness to form three-dimensional structures and the like, said thickness being defined by a first outer face, a second outer face, and a plurality of fabric layers between said first and second outer faces, said process comprising:

weaving a plurality of warp yarns in a longitudinal direction;

weaving a plurality of picks of a weft yarn in a weft direction in said fabric transverse to said warp direction;

weaving said warp yarns in undulations rising and sinking between said first and outer faces;

weaving said weft yarn picks in said weft direction in undulations rising and sinking between said first and second outer faces;

weaving said warp yarns in pairs of rising and pairs of sinking paris of warp yarns between said first and second outer faces;

weaving said weft yarns in rising and sinking pairs between said first and second outer faces;

inserting at least a pair of said weft yarns between pairs of rising and pairs of sinking warp yarns; and arranging at least a pair of said warp yarns between pairs of rising and pairs of sinking weft yarns.

34. The process of claim 33 including weaving said rising and sinking warp and weft yarn pairs between said first and second outer faces to effectively form interstices and slanted troughs running through said fabric of generally equal configurations so that said fabric may be uniformly impregnated with a conformal material to set said fabric in a desired shape.

35. The process of claim 33 including weaving said fabric having N layers with 2N basic warp yarns woven in a 2N yarn repeat.

36. The process of claim 33 including weaving (2N−2) basic weft yarns in a (2N−2) yarn repeat interlaced with said 2N basic warp yarns in said 2N warp yarn repeat.

37. The process of claim 33 including weaving 2N×2N total warp, and weft yarns in a complete pattern.

38. The process of claim 33 including weaving said warp yarns in a repeat wherein said warp yarns weave over (2N−2) picks in a first position; and then said warp yarns weave over (2N−X) picks for the next (N−1) positions, where X=the next (N−1) consecutive odd integers beginning with 1, as said warp yarns rise and sink between said first and second outer faces.

39. The process of claim 38 including displacing successive warp yarns one pick in the warp direction in said warp yarn repeat.

40. The process of claim 38 including weaving said weft yarns in a repeat wherein said weft yarns weave under one warp yarn in a first position, and then weave under (2N−X) warp yarns for the next (N−1) positions, where X is the (N−1) decreasing consecutive odd integers beginning with (2N−3).

41. The process of claim 40 including displacing each successive weft yarn in the weft direction by one warp yarn position.

42. A process of constructing a reinforced composite structure having increased structural integrity comprising:

utilizing a multi-layer woven fabric having a pair of outer faces between which multiple layers are woven, said multiple layers including warp yarns woven in a first direction which rise and sink between said outer faces, said warp yarns being interwoven with weft yarns woven in a second direction transverse to said first direction which rise and sink between said first and second outer faces so that uniform flexibility is provided is said first and second directions;

conforming said multi-layer flexible fabric to the shape of said structure; and impregnating said fabric with a shape-setting material which sets said fabric in said desired structural shape.

43. The process of claim 42 including impregnating said fabric with a resin.

44. The process of claim 42 including impregnating said fabric by drawing said shape setting material through said fabric with a vacuum.

45. The process of claim 42 including utilizing a multi-layer woven fabric wherein said weft yarns extend between said outer face of said fabric in slanted runs which facilitate flexibility and impregnation of said fabric with said shape setting material.

46. The process of claim 42 including using a multi-layer fabric in which said weft yarns are inserted between pairs of rising and pairs of sinking warp yarns, and said warp yarns are inserted between pairs of rising and pairs of sinking weft yarns.

* * * * *